United States Patent [19]
Schaper et al.
[11] 4,443,266
[45] Apr. 17, 1984

[54] CONTINUOUSLY OPERATING SUGAR CENTRIFUGE

[75] Inventors: Helmut Schaper, Braunschweig; Heinrich Kurland, Lucklum, both of Fed. Rep. of Germany

[73] Assignee: Braunschweigische Maschinenbauanstalt AG, Braunschweig, Fed. Rep. of Germany

[21] Appl. No.: 398,615

[22] Filed: Jul. 15, 1982

[30] Foreign Application Priority Data

Jul. 25, 1981 [DE] Fed. Rep. of Germany ..... 3129392

[51] Int. Cl.³ ..... C13F 1/06
[52] U.S. Cl. ..... 127/19; 127/9; 210/363; 210/368; 210/377; 210/380.1; 494/1; 494/57
[58] Field of Search ..... 494/1, 43, 56, 57, 67, 494/74, 79; 210/363, 381, 377, 379, 371, 368, 380.1; 127/19, 9, 20

[56] References Cited

U.S. PATENT DOCUMENTS

| | | | |
|---|---|---|---|
| 4,253,960 | 3/1981 | Dudley et al. | 210/380.1 X |
| 4,298,476 | 11/1981 | Dudley | 494/79 X |
| 4,332,621 | 6/1982 | Kurland et al. | 127/19 |

FOREIGN PATENT DOCUMENTS

| | | |
|---|---|---|
| 268164 | 2/1969 | Austria . |
| 1927179 | 9/1965 | Fed. Rep. of Germany . |
| 2026479 | 3/1972 | Fed. Rep. of Germany . |

*Primary Examiner*—Kenneth M. Schor
*Attorney, Agent, or Firm*—W. G. Fasse; D. H. Kane, Jr.

[57] ABSTRACT

A continuously operable sugar centrifuge modified as taught herein is capable of producing quality sugar. For this purpose elastic, spring resilient sheet metal members (11) are attached to a rotatable ring with an adjustable angle of incidence so that the surface of these flexible sheet metal members encloses a selectable incidence angle with the flight path (12) of the sugar crystals, whereby the speed with which the sugar crystals impinge on the flexible sheet metal members may be controlled. Such control may be accomplished, for example, by a closed loop deceleration or braking action of the rotatable ring carrying the metal members.

14 Claims, 4 Drawing Figures

CONTINUOUSLY OPERATING SUGAR CENTRIFUGE

CLAIM TO PRIORITY

The present invention is based on the corresponding German Serial Number P 31 29 392.1, filed in the Federal Republic of Germany on July 25, 1981. The priority of the German filing date is claimed for the present application.

BACKGROUND OF THE INVENTION

The invention relates to a continuously operable sugar centrifugal having a centrifugal drum with an upwardly opening cone shape surrounded by a sugar collecting housing. At the upper wide conical end of the drum there are arranged sugar baffle elements surrounding a sugar discharge flange forming the upper end of the drum. These sugar baffle elements are secured to a rotatable ring which is equipped with means for influencing or controlling the r.p.m. of the ring.

Sugar centrifugals of the continuously operating type as mentioned above have been developed in recent years to a high level of performance. The throughput capacities of these centrifugals are very large and they produce a sugar having a degree of purity which is equal to that produced by periodically operating batch type centrifugals.

It is well known that a continuously operating production process is always more advantageous than a periodically or batchwise operating process. It is also well known that a continuously operating centrifugal is substantially simpler in its structure than a batch type centrifugal. Accordingly, continuously operating centrifugals are also more economical with regard to their initial investment expense and with regard to their operating costs as compared to batch type centrifugals. Nevertheless, continuously operating centrifugals have not been able yet to replace the periodically batch type centrifugals in the sugar industry, especially where the production of quality sugar is involved. This is so because the sugar crystals are damaged in continuously operating centrifugals when these crystals impinge upon the wall of the centrifuge housing as the sugar crystals fly off the upper drum edge at high speeds.

It is not practical to naturally decelerate the sugar crystals by friction with the surrounding air because such frictional deceleration would require a flight path of substantial length for the sugar crystals. This means that the housing of the centrifuge would require a diameter of several meters. Experiments in which the air friction was increased by increasing the air pressure or by means of directed air streams have not been successful in the attempt of catching the sugar crystals in the centrifuge housing without any danger of damaging the sugar crystals.

Other experiments to decelerate or deflect the sugar crystals have also been without success. Thus, in the centrifugal according to Austrian Pat. No. 268,164 it was intended to provide a gentle deceleration and deflection of the sugar crystals by means of a rotatable ring which reaches with an inclined baffle surface into the flight path of the sugar crystals. Such gentle deceleration and deflection was supposed to even be improved by applying a deceleration to the ring and by exposing the sugar crystals to an air stream. However, the desired result could not be achieved because any sliding contact between the sugar crystals flying at high speed and the solid surfaces of the baffle ring resulted in an abrasion of the sugar crystal surfaces, thereby dulling the crystals. Additionally, a sugar crust was very rapidly formed on the solid surfaces due to the sugar abrasion so that centrifugals as disclosed in Austrian Pat. No. 268,164 became inoperable even after short operating periods.

The same result has been noticed in connection with a centrifugal disclosed in German Patent Publication (DE-AS) 2,026,479. The centrifuge according to this reference is equipped with a rotatable ring carring vane type curved deflection plates. These deflection plates are intended to initially extend parallel to the flight path of the sugar crystal and to then gradually merge into the flight path with an ever increasing curvature in order to cause a deflection or detouring of the sugar crystals. In such an arrangement the kinetic energy of the sugar crystals is transmitted at least partially through the deflection plates to the rotatable ring. However, the sliding contacts between the surfaces of the solid deflection plates and the sugar crystals again produce a crystal abrasion with the resulting dulling and with a rapidly growing incrustation on these deflection plates.

In addition to the above described attempts of the prior art to solve the problems encountered in connection with the damage to the sugar crystals in continuously operating centrifugals, it has been suggested heretofore to construct the baffle elements of flexible or elastical materials such as synthetic materials or rubber. Reference is made in this connection to German Utility Model (DE-GM) 1,927,179. Such baffle elements of rubber or synthetic material however have not been capable of withstanding the very heavy mechanical wear and tear to which they are exposed. Thus, these elements were very rapidly destroyed in the operation of these centrifugals. In the sugar centrifugal according to said German Utility Model a baffle ring is located adjacent to the output end of the centrifugal drum. The baffle ring is made of a soft material or its surface is covered by a soft material. In any event, the soft material is rapidly destroyed.

Experiences gathered in years past in connection with continuously operating solution centrifugals support the conclusion that baffle elements made of synthetic material or rubber must be destroyed in very short periods of time. Such solution sugar centrifugals are equipped, instead with the above mentioned known baffle rings provided with a soft inner coating, with a curved baffle ring on which the sugar crystals are intentionally mechanically comminuted. It has been found during the testing time that these baffle rings which have been initially made of normal steels, exhibited even after a single campaign wear and tear zones having a depth of many millimeters. Stated differently, these baffle rings of normal steel were destroyed after a single campaign. Thus, it was necessary to use special steels for producing baffle rings capable of withstanding the mechanical wear and tear. Thus, it is understandable, that the baffle elements made of rubber or synthetic material do not stand a chance to withstand the wear and tear imposed on these rings by the sugar crystals.

OBJECTS OF THE INVENTION

In view of the above it is the aim of the invention to achieve the following objects singly or in combination:

to improve a continuously operating sugar centrifugal in such a manner that damage to the sugar crystals is diminished to such an extent that the produced sugar is comparable at least with the minimal requirements for quality sugar;

to assure the continuous operation of a continuously operable sugar centrifugal by avoiding the incrustations which heretofore have impaired the operation of such centrifugals;

to strongly damp the impinging of the sugar crystals on the baffle elements to such an extent that a selectable reduction of the impinging energy may be achieved;

to substantially reduce the impact speed of the sugar crystals on the baffle elements and thus the impact energy to avoid damage to the sugar crystals;

to make sure that each individual sugar crystal will impinge only once on the surface of the baffle elements;

to avoid the comminuting of the sugar crystals which made it practically impossible to use continuously operating centrifugals for the production of quality sugar heretofore;

to provide for a manual and/or automatic adjustment of the baffle elements, preferably in response to the circumferential speed of these baffle elements, or rather of the ring carrying these baffle elements; and to provide for a controllable deceleration of the rotatable ring carrying the ring baffle elements, whereby the control shall be responsive to any one or more of a plurality of control factors.

SUMMARY OF THE INVENTION

According to the invention the rotatable ring carrying the sugar deflecting means adjacent to the upper edge of the centrifugal drum is equipped with sugar baffling elements in the form of plane, thin, elastic, spring-like sheet metal members which are secured to the ring so as to be rotatable or rather, adjustable, to a desired angle of incidence for the sugar crystals relative to the flight path direction of the crystals. The adjustment axis for this angle of incidence extends in parallel to the rotational axis of the centrifugal drum. By properly adjusting the angle of incidence for each of the sheet metal members, the invention achieves that each sugar crystal impinges only once in a strongly damped manner on the sheet metal members. Further, these sheet metal members, depending on the adjustment of the angle of incidence relative to the flight path of the crystals cause a decelerated reflection and/or a change in the flight direction of these sugar crystals.

The spring-like sheet metal members are so thin, for example, in the range of 0.1 mm to 1.0 mm, that even the impingement of a single sugar crystal is able to deflect or elastically deform the respective sheet metal member. The elastical deformation of the sheet metal members causes a damping or energy transfer from the crystal to the spring-like sheet metal. Such damping or energy transfer increases progressively with an increasing deflection of the sheet metal members.

The energy transferred from the sugar crystals to the sheet metal members is partially transformed into heat as a result of the work required for deforming the spring-like sheet metal members. The remaining energy content or proportion generates a torqure moment which imparts rotation to the ring carrying the sheet metal members. The r.p.m. of the ring may be selected in a desirable manner, whereby it is possible to select the reduction of the impinging energy. This feature of the invention, is in addition to the elastic damping of the impinging, of substantial importance because the impinging energy is proportional to the square of the speed of the crystals. If the rotatable ring rotates so fast in the same direction as the centrifugal drum, that the circumferential speed of the spring-like sheet metal members is half as large as the travelling or flight speed of the sugar crystals, then the impinging speed is cut down to one half of the impinging speed normally encountered. These theoretical considerations apply in that instance in which the sugar crystals impinge on the spring-like sheet metal members at a right angle. However, according to the invention the impinging angle $\alpha$ is also adjustable. Thus, when the sugar crystals impinge on the sheet metal member at a slant, only the speed component will be effective which extends perpendicularly to the impinging surface of the sheet metal members. For example, when the impinging angle is 30° the effective speed component corresponds to one half of the entire speed of the sugar crystal.

Thus, according to the invention, two influential values are effective in combination in reducing the impinging speed and thus the impinging energy of the sugar crystals in a substantial manner. These two influential values are the circumferential speed of the springy sheet metal members and the angle of incidence of these sheet metal members relative to the flight or travel direction of the sugar crystals. Nevertheless, these two features alone are not sufficient to avoid damage to the sugar crystals. The above mentioned German Patent Publication (DE-AS) 2,026,479 shows that the impinging angle should be almost zero or at least very small in order to avoid a splitting of the sugar crystals. However, if the impinging angle is selected to be so small, the sugar crystals slide in a frictional and rubbing manner along the impinging surface, whereby the sugar crystals are damaged by abrasion. Thus, according to the invention the angles of incidence of the springy sheet metal members which would result in such abrasion, shall be avoided. Accordingly, the invention employs a third influential value for avoiding the abrasion and such third influential value is the elastic damping of the sugar crystals according to the invention. In the apparatus according to the invention the sugar crystals are allowed to impinge on the surface of the sheet metal members but once, whereby only a single edge, corner, or surface of a crystal is temporarily exposed to a damaging effect. In order to achieve this objective it is necessary that the spring-like sheet metal members are adjusted relative to the flight direction of the sugar crystals to such an extent that the sugar crystals are deflected with certainty. This approach is substantially different from the above discussed prior art.

The damping characteristic of the spring-like sheet metal members becomes in practice a fixed value. This fixed value is defined or determined by the dimensions and material characteristics of the respective sheet metal of which the sheet metal members are made. This value or damping characteristic also depends on the spacing of the point of impingement of a sugar crystal from the point where the respective sheet metal member is secured to the supporting ring. In other words, a large spacing between the just mentioned two points results in a large deflection moment. As stated above with regard to German Patent Publication (DE-AS) 2,026,479, the prior art uses solid, that is, not yielding, baffling elements. Contrary thereto according to the invention an impinging of the sugar crystals on the baffling sheet metal members is not avoided, rather the invention makes sure that each sugar crystal impinges but once on a sheet metal member, whereby the impact is adapted to the mechanical abrasion resistance of the sugar crystals and whereby the impact involves a comparatively large energy without causing any comminution of the sugar crystals due to the spring-like deflection of the sheet metal members. According to the invention it is possible to select the impinging energy in such a manner that the damages to the sugar crystals are minimized and that the sugar can be classified as quality sugar. This is possible with the aid of a suitable adjustment of the circumferential speed of the ring carrying the sheet metal members and by a suitable adjustment of the angle of incidence of the sheet metal members relative to the direction of the flight path of the sugar crystals.

With these adjustable features of the invention it is not only possible to produce quality sugar, it is also possible to operate the centrifugal safely and without the danger of an incrustation of the sheet metal deflecting or baffling members. According to the invention the sugar crystals do not have a sliding contact with the surfaces of the spring-like deflecting sheet metal members. Therefore, sugar particles cannot be deposited on the surfaces due to sugar abrasion. It has been found that the extremely small sugar traces that could possibly be deposited after prolonged periods of time on the surfaces of the spring-like sheet metal members and any deposits that might result due to moist surface skins of sugar crystals which have not yet been dried, do not find any foot holds on these surfaces of the sheet metal members and thus cannot result in incrustations because these sheet metal members are continuously performing spring-like bending movements, whereby any deposits are prevented, because even temporary deposits are caused to fall off again by the continuous flexing movements of the sheet metal members. Additionally, the continuous impinging of new sugar crystals on the sheet metal member surfaces have the effect of sandblasting, thereby also keeping these surfaces clean. This cleaning effect may be optimized, if desired, by a suitable or advantageous angle of incidence of the sheet metal members. Further, the centrifugal force to which the flexing sheet metal members are exposed during operation and which is adjustable by the selection of the r.p.m. of the rotatable ring carrying sheet metal members, also has a cleaning effect on the spring-like sheet metal members secured to the ring. Another factor to be considered in this respect is the smoothness of the surface of the sheet metal members. The smoother the surface is, the smaller is the possibility of sugar deposits on these surfaces.

With regard to the operational life of these sheet metal members it is possible to achieve satisfactory results by using special steel alloys well known in the art.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
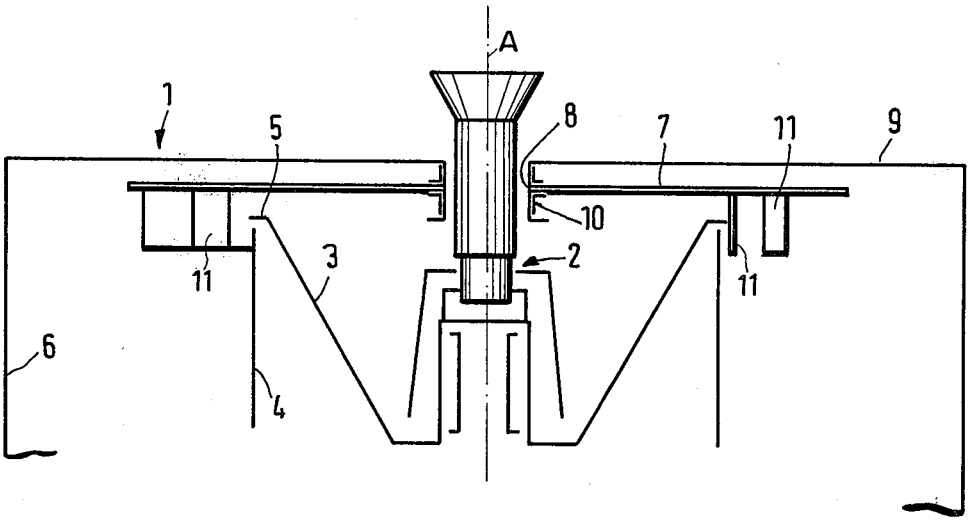
FIG. 1 illustrates a schematic sectional view through a centrifuge according to the invention, whereby the section extends vertically through the rotational axis of the centrifuge.

FIG. 1 illustrates a continuously operable sugar centrifuge 1 comprising a filling device 2 for supplying massecuite into a centrifugal drum 3 having a truncated conical shape opening upwardly. The sugar crystals are separated from the liquid phase of the massecuite on the surface of the screens of the centrifugal drum 3. The liquid phase is collected in an inner housing 4 from which it is removed. The sugar crystals are travelling on the screens of the drum 3 toward the upper discharge edge 5 of the drum. The sugar crystals fly off the upper discharge edge 5 with a very high speed depending on the circumferential speed of the discharge edge 5. The sugar crystals travel in a direction toward the outer sugar collecting housing 6.

A rotatable member 7, for example, in the form of a ring or a solid disk is rotatably arranged above the centrifugal drum 3. The ring or disk 7 is supported in a bearing 8 for rotation. The bearing 8 is in turn secured to the cover 9 of the sugar collecting housing 6. A brake mechanism 10 of conventional construction is operatively positioned to apply a deceleration force to the ring or disk 7.

Figure 2:
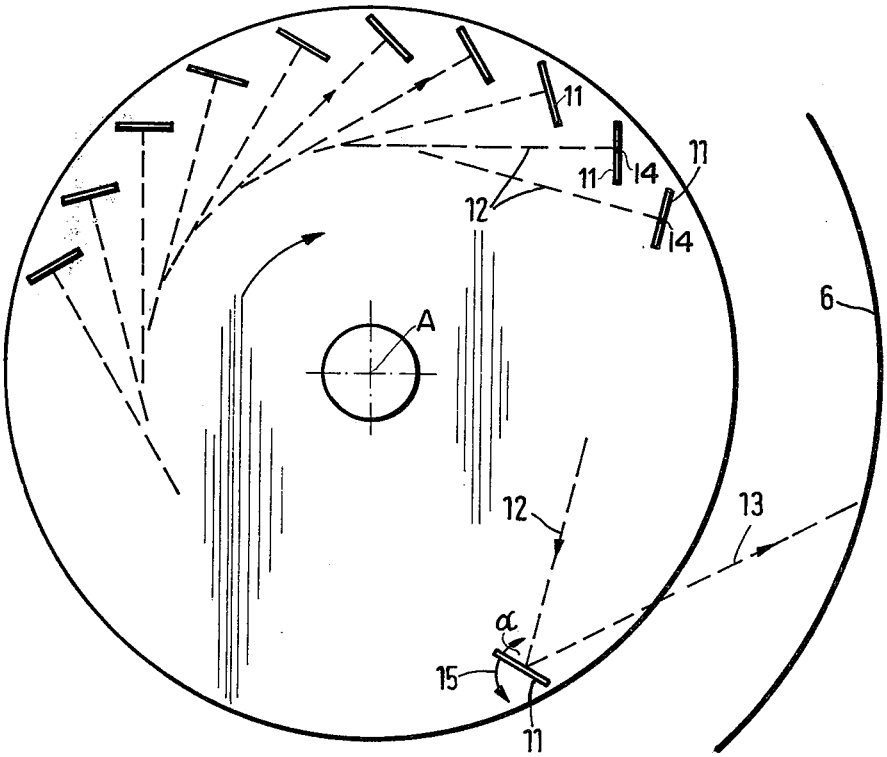
FIG. 2 is a schematic top plan view for illustrating the adjustment of the angle of incidence of the spring-type sheet metal deflecting or baffling members.

According to the invention spring-like thin sheet metal members 11 are secured to the rotatable ring 7. These members 11 have a plane surface and are very thin, for example, in the order of 0.5 mm. These spring-type metal members 11 reach into the flight path 12 of the sugar crystals as shown in FIG. 2. These members 11 are so constructed that under the impact of the sugar crystals they are elastically deflected in the manner of a spring. The deflection amplitude depends on the spacing of the point of impact of a sugar crystal from the point where the members 11 are secured to the ring or disk 7. The deflection increases with the size of the spring. If the bearings 8 are vertically adjustable up and down it is possible to vary or modify the impact distance.

Referring to FIG. 2, the adjustment of the incidence angle between the plane of each individual sheet metal member 11 and the flight direction 12 of the sugar crystals is critical. In the upper portion of FIG. 2 the sheet metal members 11 are adjusted rotationally about their rotational axis 14 so that the sugar crystals impinge on the surface of the members 11 at a right angle. The lower right-hand part of FIG. 2 shows the adjustment of the incidence angle $\alpha$ to less than 90° relative to the flight direction 12 of the crystals. In this position the sugar crystals are deflected in the direction 13 for collection in the outer housing 6. Due to this adjustment of the spring-type metal members 11 a spring-type damping is imparted on the sugar crystals at the time of impinging on the members 11 so that further damage of the sugar crystals is avoided when they should contact the inner surface of the sugar collecting housing 6.

Figure 4:
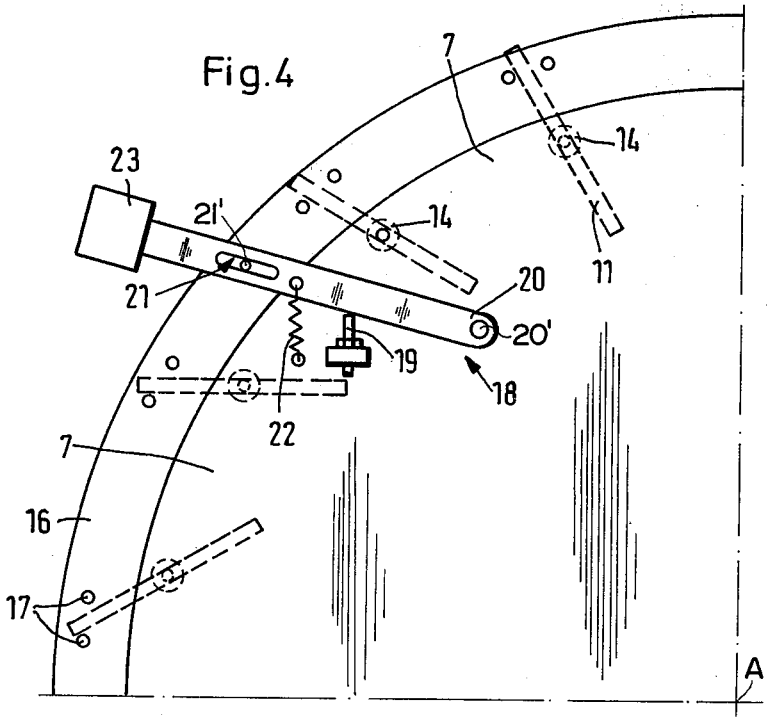
FIG. 4 illustrates a schematic top plan view of an example for adjusting the angle of incidence of the spring-like sheet metal members.

FIG. 4 shows that the spring-type sheet metal members 11 are rotatable about their respective axis 14. All the axes 14 extend in parallel to the rotational axis A of the centrifugal drum 3. Thus, each of the sheet metal members 11 is movable in the direction of the arrow 15 shown in FIG. 2 for adjustment into the most advantageous angular position relative to the flight path 12. In selecting the incidence angle $\alpha$ it will be taken into account that the spring-type sheet metal members 11 are still sufficiently deflected by the impinging sugar crystals for avoiding surface incrustations. Further, adjustment of the angle $\alpha$ will take into account that the sandblasting effect of the impinging sugar crystals also is advantageous for cleaning the sheet metal members 11.

FIG. 4 illustrates means for adjusting the sheet metal members 11 into the most advantageous position. For this purpose an adjustment ring 16 is operatively supported on the rotatable ring 7 for rotation relative to the ring 7. The adjustment ring 16 comprises stop members 17 positioned for cooperation with the respective sheet metal member 11 at a predetermined spacing from the rotational axis 14. An adjustment device 18 comprising a lever arm 20 is operatively connected to the adjustment ring 16. For this purpose the lever arm 20 is pivoted at 20' to the ring or disk 7. An adjustment screw 19 is operatively imposed between the lever arm 20 and the ring or disk 7 to adjust the instantaneous position of the lever arm 20 against the action of a spring 22. The lever arm 20 is provided with a longitudinal slot 21 through which a fixed pin 21' extends. The pin 21' is rigidly secured to the adjustment ring 16. The free end of the lever 20 is provided with a weight 23 which operates in the manner of a centrifugal controller. The spring 22 tends to hold the lever 20 in the shown position in which the lever 20 takes up an angle relative to any radial direction extending from the rotational axis A. However, due to the weight 23 there is a tendency of the lever arm 20 to assume a radially extending position in response to the rotation of the disk or ring 7. The extent of the movement of the lever 20 toward a radial position depends on the r.p.m. of the ring or disk 7, whereby the adjustment ring 16 is moved in the desired direction for adjusting the angular position of the sheet metal members 11. The adjustment screw 19 assures a predetermined initial position for these members 11. The characteristic or stiffness of the spring 22 and the position of the weight along the free end of the lever 20 are so balanced relative to each other that the initial position determined by the screw 19 of the metal members 11 is varied in response to the r.p.m. of the ring or disk 7.

The r.p.m. of the ring or disk 7 may be influenced or controlled by a brake 10 shown in FIG. 1, or by an eddy current brake 10' shown in FIG. 1. The eddy current brake 10' as such is of conventional construction and its main advantage is a simple and very fine controllability in an open loop or closed loop manner. A control mechanism 10'' is operatively connected to the eddy current brake 10'. When an eddy current brake 10' is used for controlling the r.p.m. of the disk or ring 7, there is a possibility of compensating any operational variations which in connection with a continuously operating centrifuge 1, may result in changes of the current input of the motor driving the centrifugal drum 3. The motor is not shown in the drawings.

The above described adjustment of the position of the adjustment ring 16 relative to the ring or disk 7 in combination with the described control of the brake 10 or 10' provides in practice a substantial range in which the angular position of the spring-type sheet metal members 11 may be varied in accordance with the particular requirements of any individual situation. For example, the mentioned automatic adjustment by means of centrifugal force responsive elements 20, 22, 23 may be supplemented and/or replaced by a manual adjustment of the ring 16. For example, if the centrifugal force responsive adjustment is made such that the incidence angles $\alpha$ of the sugar crystals become smaller in response to an increasing circumferential speed of the spring-type members 11, then the drive moment or torque imparted to these metal members 11 by the sugar crystals also becomes smaller as the circumferential speed of the ring 7 increases. The same effect may be achieved by a reduction of the impinging speed of the crystals on the members 11 in response to an increasing circumferential speed of the ring 7. As long as there is a sufficiently strong deceleration of the sugar crystals, it is possible to avoid any substantial expense for the control of the braking action by means of the brakes 10 or 10' as applied to the rotatable ring 7. In such an instance the system controls itself substantially automatically.

It is also possible to proceed in such a manner with the control that the impinging energy of the sugar crystals on the members 11 is held within narrow tolerances. Thus, it is possible to achieve an optimally gentle handling of the sugar crystals. However, in this type of control it is necessary to use a respective control of the decelerating action of the brakes 10 or 10' as applied to the ring 7.

As mentioned, the control of the angular position of the members 11 may be accomplished manually and/or in the manner described with reference to FIG. 3. Especially the automatic control in response to the circumferencial speed of the ring or disk 7 may be essential because even in connection with continuously operating sugar centrifugals fluctuations or variations in the operational parameters may occur, for example the throughput may vary or the crystal proportion of the massecuite may differ from time to time. Such fluctuations or variations are effective to correspondingly change the torque which causes the rotation of the rotatable ring 7. If one keeps the deceleration or brake moment constant, corresponding or analog changes in the r.p.m. of the rotatable ring or disk 7 or changes in the circumferential speed of the sheet metal members 7 would be the result. The impinging energy of the sugar crystals of the members 11 would be accordingly modified, thus preventing the maintaining of a selected impinging energy. However, this is easily avoided by a control mechanism for adjusting the angular position of the sheet metal members 11 as described above with reference to FIG. 3 which mechanism is responsive to centrifugal forces to thereby compensate for such fluctuations and variations.

The brake 10 shown in FIG. 1 could be a simple frictional brake. However, wear and tear on the brake linings must be taken into account. On the other hand, brakes equipped with an impeller wheel cooperating with a flowing medium work without wear and tear, but are more expensive. The same applies to the electrical eddy current brake 10' shown in FIG. 3. Although this type of brake is more expensive, the control, especially the closed loop control, is substantially simpler. For example, the electrical eddy current brake may be controlled in closed loop fashion in direct, analog response to the load responsive current input of the drive motor of the centrifuge. Increasing or decreasing throughput quantities of massecuite may cause an increasing or decreasing current input of the drive motor. Thus, if the ratio of solids to liquids of the massecuite is kept constant, the spring-type metal members 11 will respectively intercept more or fewer sugar crystals per unit of time and the rotatable ring 7 would rotate with a higher or lower r.p.m. while the braking effect would be kept constant. This would in turn cause a reduction or an increase in the impinging speed of the sugar crystals on the members 11. Under extreme operating conditions this could either result in an insufficient deceleration or braking effect or it could result in a too strong mechanical loading of the sugar crystals. However, if the braking or deceleration effect is controlled in closed loop fashion in response to the current input of the drive motor, then the impinging speed once adjusted remains constant. The same result may be achieved with respective closed loop control means in connection with a hydraulic flow brake. A frictional brake may also be controlled by known means, for example by pneumatic or hydraulic devices.

Figure 3:
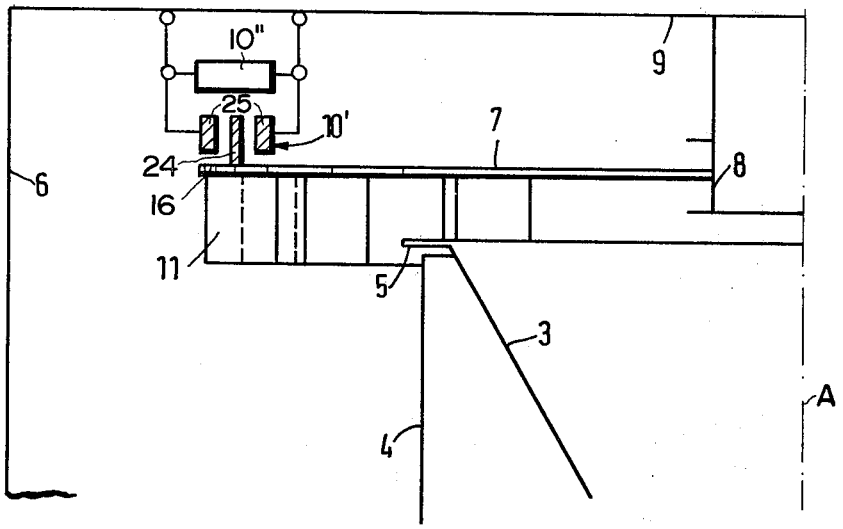
FIG. 3 is a view similar to that of FIG. 1, but showing an example embodiment for a brake to control the r.p.m. of the ring carrying the sheet metal baffling members.

Incidentally, FIG. 3 shows that the eddy current brake 10' comprises two induction coils 25 which are stationary and which are, for example, secured to the cover 9 of the housing 6. These coils 25 cooperate with an induction ring 24 secured to and rotating with the ring or disk 7 or with the adjustment ring 16 shown in FIG. 4. Such eddy current brakes are well known.

A continuously operating sugar centrifugal as described above with reference to the drawing is capable of safely producing sugar, the crystals of which are handled sufficiently gently so that the sugar may be used as so-called quality sugar.

Although the invention has been described with reference to specific example embodiments, it will be appreciated, that it is intended to cover all modification and equivalents within the scope of the appended claims.

What is claimed is:

1. In a continuously operating sugar centrifuge having a conical centrifugal drum with a wide upper end and a liquid collecting housing and a sugar crystal collecting housing in which housings said drum is mounted for rotation, said upper end of the drum forming a sugar discharge flange surrounded by sugar baffle means secured to a rotatable means (7), the improvement comprising a plurality of planar, thin, elastic, springy sheet metal members (11) forming said baffle means, axis means (14) for rotatably securing said sheet metal members (11) to said rotatable means (7), and means for adjusting the angular position of said sheet metal members (11) relative to the direction of a flight path (12) of a sugar crystal flying off said sugar discharge flange (5) for reducing mechanical damage to the sugar crystals.

2. The centrifuge of claim 1, further comprising means (10, 10') for controlling the r.p.m. of said rotatable means (7).

3. The centrifuge of claim 1 or 2, wherein said means for adjusting the angular position of said sheet metal members comprise an adjustment ring (16) operatively connected to said rotatable means (7) for adjusting the adjustment ring in its position relative to the rotatable means (7), stop means (17) rigidly secured to said adjustment ring (16) for cooperation with the respective sheet metal member (11), said stop means (17) being sufficiently spaced from the axis means (14) of the respective sheet metal member for controlling the angular position of said sheet metal members by a relative displacement between the rotatable means (7) and the adjustment ring (16).

4. The centrifuge of claim 3, wherein said adjusting means further comprise an adjusting device (18) operatively interposed between said rotatable means (7) and said adjustment ring (16).

5. The centrifuge of claim 4, wherein said adjusting device comprise means for manually adjusting said adjusting device.

6. The centrifuge of claim 4, wherein said adjusting device (18) comprises one or more springs (22) operatively interposed between said rotatable means (7) and said adjustment ring (16), said springs exerting a force component on said adjustment ring which force component is effective in the circumferential direction of the adjustment ring (16).

7. The centrifuge of claim 4, wherein said adjusting device (18) comprises centrifugal force responsive control means (20, 21, 22, 23) for controlling the r.p.m. of said rotatable means (7) carrying said sheet metal members.

8. The centrifuge of claim 2, wherein said r.p.m. control means for controlling the r.p.m. of said rotatable means (7) comprise brake means (10, 10').

9. The centrifuge of claim 8, wherein said brake means are adjustable for varying the brake force applied to said rotatable means (7), whereby the adjustment of said brake force may be made in a closed or open loop manner.

10. The centrifuge of claim 8 or 9, wherein said brake means (10, 10') is controllable in response to the circumferential speed of said rotatable means (7).

11. The centrifuge of claim 8 or 9, wherein said brake means is controllable in response to the throughput of the centrifuge.

12. The centrifuge of claim 8 or 9, wherein said means for adjusting comprise an adjustment ring (16) operatively connected to said rotatable means, said brake means being directly or indirectly effective on said adjustment ring (16).

13. The centrifuge of claim 8 or 9, wherein said brake means comprise an eddy current brake including an induction ring (24) secured to said rotatable means (7), said induction ring (24) extending perpendicularly from said rotatable means, and induction coils stationarily secured to said housing for cooperation with said induction ring.

14. The centrifuge of claim 13, wherein said rotatable means comprise an adjustment ring forming said means for adjusting the angular position of said sheet metal members, said induction ring (24) being secured to said adjustment ring.

* * * * *